US006032878A

United States Patent [19]

Lacroix et al.

[11] Patent Number: 6,032,878

[45] Date of Patent: Mar. 7, 2000

[54] LEVER-CONTROLLED COMPRESSED-AIR GUN

[75] Inventors: Jean-Jacques Lacroix, Lovagny; Christophe Laporte, Doussard, both of France

[73] Assignee: Staubli Faverges, Faverges, France

[21] Appl. No.: 09/127,831

[22] Filed: Aug. 3, 1998

[30] Foreign Application Priority Data

Sep. 1, 1997 [FR] France ..... 97 11033

[51] Int. Cl.[7] ..... B05B 1/30

[52] U.S. Cl. ..... 239/579; 239/583; 251/155; 285/315

[58] Field of Search ..... 251/155; 239/579, 239/578, 583, 541; 285/314, 315, 322

[56] References Cited

U.S. PATENT DOCUMENTS 4,676,269 6/1987 Sarson ..... 137/614.06

FOREIGN PATENT DOCUMENTS 0223752 5/1987 European Pat. Off. .

1425900 4/1969 Germany ..... 239/583

*Primary Examiner*—David J. Walczak

*Assistant Examiner*—Tuan Nguyen

*Attorney, Agent, or Firm*—Dowell & Dowell, P.C.

[57] ABSTRACT

A compressed-air gun which includes a substantially tubular body adapted to corporate with a releasable retention element inside a central bore of a female quick connect element to thereby maintain the body in position in the central bore and which includes a tubular nozzle adapted to engage and manipulate a valve inside the female element with the movement of the nozzle being controlled by a lever.

11 Claims, 3 Drawing Sheets

A
X'
X
B
1
1a
2
3
4
5
6
7
8
9
10
10a
10b
51
52
53
54
55
56
57
58
62
63
64
65
66
67
68
70
71

LEVER-CONTROLLED COMPRESSED-AIR GUN

FIELD OF THE INVENTION

BACKGROUND OF THE INVENTION

The present invention relates to a blow gun or compressed-air gun controlled by an articulated lever.

BACKGROUND OF THE DISCLOSURE

In workshops or garages, it is known to use compressed air as source of energy for portable pneumatic tools such as drills or screwdrivers. It is also known to use compressed air for cleaning work stations or machines, by expelling the chips or dust with the aid of an air jet. For such cleaning, a blow gun or compressed-air gun is used, i.e. a controlled nozzle which may be opened or closed by the user as desired, with the aid of a lever.

Blow guns exist, whose sole function is to deliver air under pressure.

Blow guns of particular type also exist, which may be connected to portable tools. In that case they perform the function of removable pipe join commonly called "quick connection". When a tool is connected to such a blow gun, the operator is hindered by the presence of the control lever. This lever reduces the maneuverability of the tool and call lead to the operator making imprecise gestures. It has proved in practice that blow guns adapted to be connected to tools are used mostly as quick connections and, at the end of the station or end of the day, as blow guns. Consequently, the above-mentioned drawback of the operator being hindered is present most of the time, which proves to be a nuisance.

It is an object of the present invention to overcome these drawbacks by proposing a blow gun which does not hinder an operator when he wishes to use only a "quick connect" function.

SUMMARY OF THE INVENTION

To that end, the invention relates to a blow gun or compressed-air gun controlled by a lever, characterized in that it comprises a substantially tubular body adapted to cooperate with means for immobilization inside a female quick connect element to maintain the body in position in a central bore of the female element and an overall tubular nozzle adapted to displace, by sliding inside the body, a valve of the female element, the slide of the nozzle in the body being controlled by the lever.

The blow gun of the invention constitutes a removable assembly adapted to be mounted on the female element of a conventional quick connection and to be dismounted therefrom when a tool is to be used. When the blow gun is dismounted, it does not interfere with the use of the tool, which is appreciated by the operator. When the blow gun is to be mounted, it is fitted in the female part of the quick connection like a male endpiece, i.e. particularly easily. The slide of the nozzle inside the tubular body of the blow gun of the invention makes it possible to control the valve of the female element of the quick connection and in particular to allow air under pressure to enter the inside of the nozzle for the above-mentioned function of cleaning. When the blowing operation is terminated, the blow gun may be easily disconnected, which eliminates any hindrance for the user. The blow gun therefore makes it possible, temporarily, rapidly and at low cost, to transform a quick connection into a cleaning tool.

According to a first advantageous aspect of the invention, the lever is articulated about a pin supported by tabs on the body, this pin being clipped in the tabs. This aspect of the invention makes it possible to make the blow gun dismountable, while the system of articulation of the lever is particularly simple.

The lever may be provided to bear a cam adapted to cooperate with a ramp of the nozzle to displace this nozzle in the direction of the valve. The use of a cam makes it possible to transform the movement of rotation of the lever into a movement of translation of the nozzle.

In that case, the cam may be advantageously provided to be more remote from the central pin of the nozzle than the ramp. This aspect of the invention makes it possible to provide that, when the lever is first actuated, the gearing-down of the force is greater while the displacement of the nozzle is relatively slow, which makes it possible to overcome the effort exerted on the valve of the female element by the air under pressure. On the contrary, when the valve is opened, i.e. when the forces due to the pressure are balanced on either side thereof since there is no longer any tightness, the ramp may gear down the translation by approaching the central axis of the nozzle to obtain a rapid opening of the valve. Thanks to this aspect of the invention, the movement of opening is optimalized from the point of view of the efforts and the speed of opening.

The cam may advantageously be provided to be arranged on a tab connecting a part of the lever which is intended to be manipulated to the pin for articulation of the lever on the body. This contributes to the gearing-down effect.

According to another advantageous aspect of the invention, the nozzle bears at its end intended to penetrate in the female element, a valve thrust ring. This ring makes it possible to adapt the outer diameter of the nozzle to that of the valve. In this way, the nozzle will have an outer diameter of the order of 3 mm while the valve may have a larger diameter of the order of 3 to 30 mm depending on the type of the female quick connect element and, in particular, on its nominal operating pressure.

According to another advantageous aspect of the invention, the nozzle is provided with a notch defining two housings for receiving an elastic tab of the body, this tab being disposed so that its end penetrates selectively in one of the housings. This aspect of the invention makes it possible to improve the ergonomical use of the blow gun by generating two differentiated positions of the nozzle towards which the blow gun tends naturally under the effect of the resilient force created by the tab of the body.

According to another advantageous aspect of the invention, the pivoting movement of the lever is limited by the abutment of this lever on the body or on the nozzle. In particular, the body may be provided to bear a stop, adapted to cooperate with a corresponding part of the lever when the nozzle is displaced towards the inside of the female element, and the nozzle to bear a stop, adapted to cooperate with a corresponding stop of the lever when the nozzle is displaced towards the outside of the female element.

BRIEF DESCRIPTION OF THE DRAWINGS

The invention will be more readily understood on reading the following description of an embodiment of a blow gun according to the invention, given by way of example, with reference to the accompanying drawings, in which.

DESCRIPTION OF PREFERRED EMBODIMENT

Figure 1:
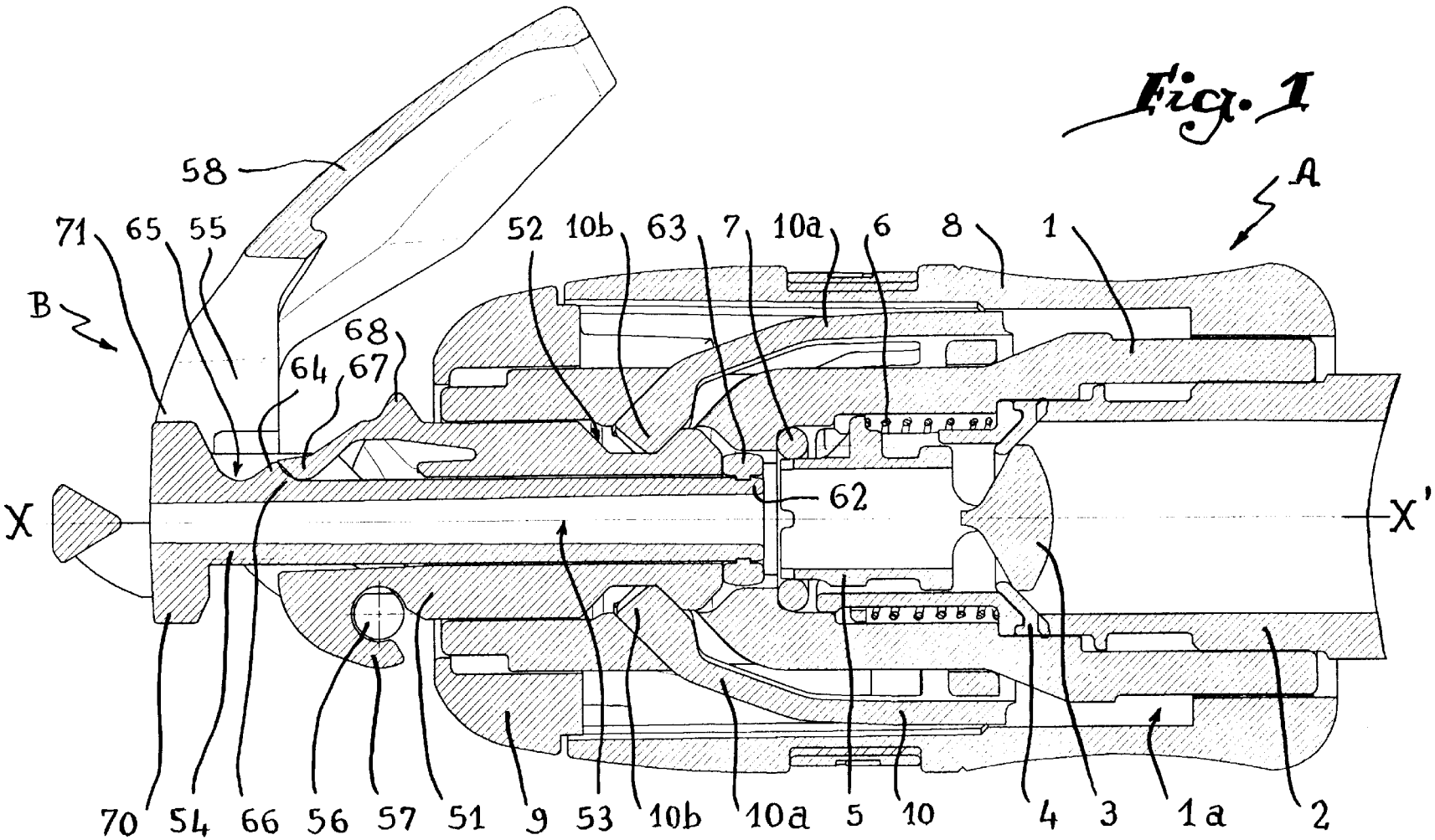
FIG. 1 is an axial section through a blow gun according to the invention mounted on a female element of a quick connection, the blow gun not being activated.

Referring now to the drawings, and firstly to FIG. 1, the body of the female element A of a quick connection is constituted by the assembly of two tubular parts, namely a principal part 1 and a rear part 2, this assembly being effected by elastic clipping. An assembly formed by a tubular valve 3, a seat or joint 4, a valve holder 5 and a return spring 6, is maintained in place inside a central bore 1*a* of the part 1 thanks to part 2. The valve holder 5 retains an O-ring 7 intended to perform a function of tightness. The valve 3 and the valve holder 5 may be made in one piece. The body formed by elements 1 and 2 is surrounded by a maneuvering sleeve 8 and a forward bush 9, bush 9 being elastically clipped inside the sleeve 8.

A so-called locking ring 10, provided with forwardly facing longitudinal claws 10*a*, i.e. facing the left in FIG. 1, slides on part 1. The free end of each of the claws 10*a* comprises a sectioned head 10*b* adapted to be wedged behind an outer radial shoulder of a male endpiece provided to cooperate with the female element A. Claws 10*a* therefore constitute one means for immobilizing a male part inside the female element A.

The compressed-air gun B according to the invention is intended to be mounted in element A. It comprises a body 51 in the form of a tubular sleeve provided with a radial peripheral groove 52 adapted to receive the heads 10*b* of the claws 10*a*, as shown in FIG. 1. In this position, the body 51 is firmly immobilized with respect to the female element A.

In the central bore 53 of the body 51 there is disposed a nozzle 54 of tubular shape which may slide with respect to body 51.

Furthermore, a lever 55 is articulated on body 51 thanks to a pin 56 clipped in two tabs of which only one, referenced 57, is visible in the Figures.

In the position of FIG. 1, body 51 is immobilized with respect to the female element A, but no action is exerted by the compressed-air gun B on valve 4.

Figure 2:
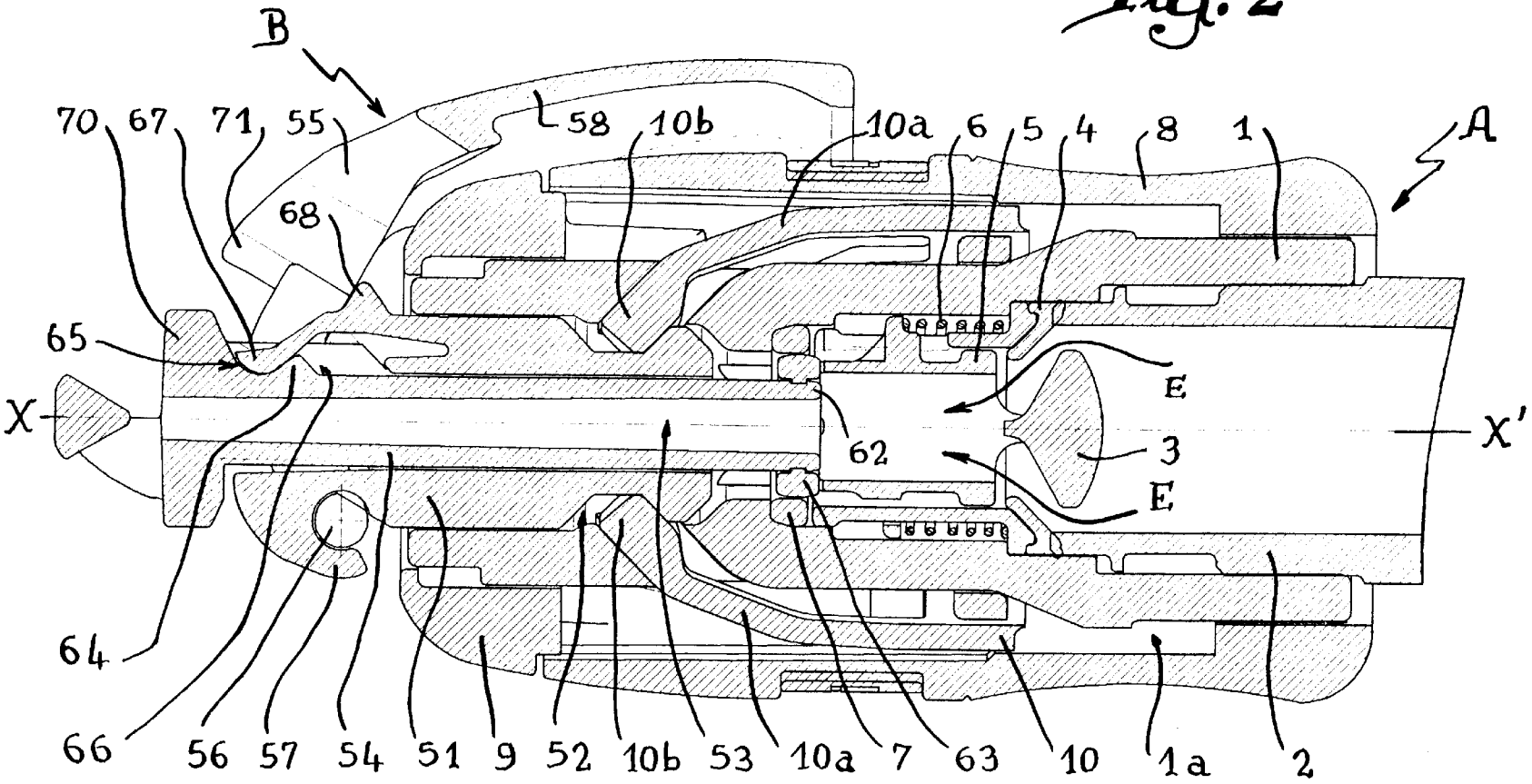
FIG. 2 is a view similar to FIG. 1, while the blow gun is activated.

In the position of FIG. 2, the lever 55 undergoes a force F tending to displace the part intended to be manipulated, or handle 58, in the direction of the sleeve 8. By this action, a cam 59 formed on a tab 60 connecting the handle 58 to the pin 56 abuts on a ramp 61 made on the outer surface of the nozzle 54. In this way, nozzle 54 is displaced in the direction of valve 3.

At end 62 of the nozzle 54 there is mounted a ring 63 having a radial face whose diameter is substantially equal to the exposed face of the valve holder 5. In this way, the end 62 of the nozzle 54 entrains ring 63 which pushes the valve holder 5 against the force of the spring 6. The effect of this is to detach the valve 3 from its seat 4 and to allow the compressed air to circulate from the upstream pipe towards the nozzle 54, the flow being represented by arrow E. The blow gun remains in this position of flow of the compressed air as long as the handle 58 remains applied on the sleeve 8.

A notch 64 is provided outside the nozzle 54 and defines two housings 65 and 66 for receiving the head 67 of an elastic tab 68 formed in the body 51. In the position of FIG. 2, the head 67 is in place in the housing 65, with the result that the elasticity of the tab 68 opposes a movement of the nozzle 54 towards the left in FIG. 2. In other words, the elasticity of the tab 68 makes it possible to create a force of reaction to the effort of closure of the valve due to the spring 6. This construction improves comfort of use of the gun, insofar as the user does not feel all the thrust effort due to the spring 6.

Furthermore, in the position of FIG. 1, the head 67 of the tab 68 is in place in the housing 66, with the result that it opposes an untimely maneuver of the lever 55. In other words, the drive of the nozzle 54 in the direction of the valve 3 can result only from an effort of the user which is sufficient to pass the head 67 of the tab 68 above the notch 64. In this way, untimely openings of the compressed-air gun are avoided.

Figure 3:
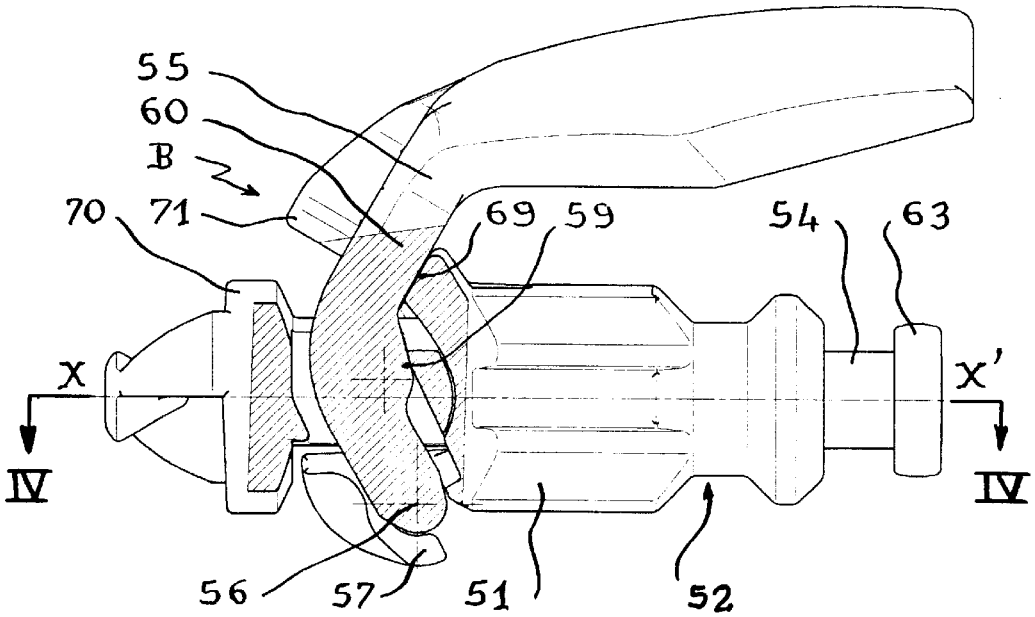
FIG. 3 is an outside view of the blow gun alone, in the position of FIG. 2, with parts broken away taken along line III—III of FIG. 4.
Figure 4:
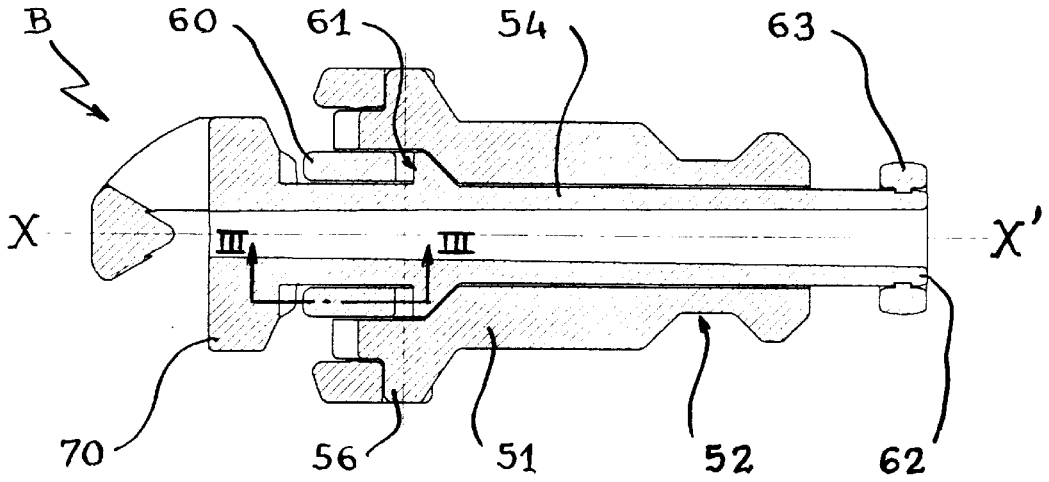
FIG. 4 is an axial section along line IV—IV in FIG. 3.

With reference to FIG. 3, it will be noted that the cam 59 is more remote from the central axis XX' of the nozzle 54 than the ramp 61. This construction makes it possible to obtain a relatively slow movement of the nozzle 54 at the beginning of its displacement in the direction of the valve, therefore an intense force of displacement of the valve, adapted to overcome the resistance due to the pressure prevailing upstream of the valve and to the force of the return of the spring 6. On the contrary, towards the end of the movement of displacement of the nozzle 54 in the direction of the valve 4, this movement may be rapid and does not necessitate a considerable force insofar as the detachment of the valve 3 with respect to the seat 4 has allowed a virtually immediate balancing of the pressures upstream and downstream of this valve.

As is more clearly apparent in FIG. 3, a stop 69 is provided on the body 51 to limit the movement of the tab 60, and therefore of the lever 55 assembly, about the pin 56. In the position of FIGS. 2 and 3, the tab 60 is in abutment against the stop 69.

Furthermore, the nozzle 54 bears a radial flange 70 adapted to cooperate with a nose 71 of the lever 55 to limit the tipping movement of the lever 55 in the direction opposite force F. In the position of FIG. 1, the flange 70 serves as stop for the nose 71 of the lever 55.

In this way, the stops 69 and 70 make it possible to limit the amplitude of the pivoting of the lever 55 and consequently the displacement of the nozzle 54, this displacement being, furthermore, controlled elastically thanks to tab 68.

The compressed-air gun B may be easily mounted and dismantled on and from element A in the manner of a male endpiece of a quick connection, while it functions particularly satisfactorily.

It will also be noted that the blow gun B, once dismantled from the female element A, constitutes a unitary assembly which may be stored without risk of being dismounted.

The invention has been presented with the lever 55 articulated about a pin. However, other means for controlling the slide of the nozzle 54 in the body 51 may be used, such as in particular an outer ring in mesh with the nozzle. This ring might comprise a rectilinear or helicoidal ramp making it possible to gear down the effort applied to the nozzle.

What is claimed is:

1. A compressed-air gun controlled by a lever, wherein the gun comprises; a substantially tubular body, means for releasably retaining said tubular body inside a female quick connect element, a valve disposed within said female element, a tubular nozzle slideably mounted within said tubular body so as to be engageable with said valve and to displace said valve of said female element, and the sliding motion of said nozzle in said body being controlled by said lever.

2. The compressed-air gun of claim 1, wherein said lever is articulated about a pin supported by tabs on said body, said pin being clipped in said tabs.

3. The compressed-air gun of claim 1, wherein said lever includes a cam adapted to cooperate with a ramp of said nozzle to displace said nozzle in the direction of said valve.

4. The compressed-air gun of claim 3, wherein said cam is more remote from a central axis of said nozzle than said ramp.

5. The compressed-air gun of claim 3, wherein said cam is arranged on a tab connecting a part of said lever, which is intended to be manipulated, to said pin.

6. The compressed-air gun of claim 1, wherein said nozzle carries at its end intended to penetrate in said female element, a valve thrust ring.

7. The compressed-air gun of claim 1, wherein said nozzle is provided with a notch defining two housings for receiving an elastic tab of said body, said tab being disposed so as to selectively seat in one of said housings.

8. The compressed-air gun of claim 1, wherein the pivoting movement of said lever is limited by the abutment of said lever on said body or said nozzle.

9. The compressed-air gun of claim 8, wherein said body includes a stop adapted to cooperate with a corresponding part of said lever when said nozzle is displaced towards the inside of said female element.

10. The compressed-air gun of claim 8, wherein said nozzle includes a stop adapted to cooperate with a corresponding stop of said lever when said nozzle is displaced towards the outside of said female element.

11. The compressed-air gun of claim 1 wherein said means releasably retaining said tubular body includes a locking ring having claws extending therefrom.

* * * * *